US009131770B2

(12) United States Patent
Stegherr

(10) Patent No.: US 9,131,770 B2
(45) Date of Patent: Sep. 15, 2015

(54) CONTAINERS

(71) Applicant: SORTIMO INTERNATIONAL AUSRUESTUNGSSYSTEME FUER SERVICEFAHRZEUGE GMBH, Zusmarshausen (DE)

(72) Inventor: Franz Stegherr, Stadtbergen (DE)

(73) Assignee: SORTIMO INTERNATIONAL GMBH, Zusmershausen (DE)

( * ) Notice: Subject to any disclaimer, the term of this patent is extended or adjusted under 35 U.S.C. 154(b) by 0 days.

(21) Appl. No.: 14/011,933

(22) Filed: Aug. 28, 2013

(65) Prior Publication Data

US 2014/0062281 A1 Mar. 6, 2014

(30) Foreign Application Priority Data

Aug. 29, 2012 (DE) ..... 10 2012 107 955

(51) Int. Cl.
*B65D 21/02* (2006.01)
*A47B 87/02* (2006.01)
*E05B 65/46* (2006.01)

(52) U.S. Cl.
CPC ..... *A47B 87/0207* (2013.01); *A47B 87/0215* (2013.01); *B65D 21/0212* (2013.01); *B65D 21/0223* (2013.01); *B65D 21/0228* (2013.01); *E05B 65/46* (2013.01)

(58) Field of Classification Search
CPC ..... B65D 21/02
USPC ..... 312/330.1; 220/326, 4.27; 108/91, 92, 108/93; 206/509–511
See application file for complete search history.

(56) References Cited

U.S. PATENT DOCUMENTS

| | | | | |
|---|---|---|---|---|
| 5,544,751 | A * | 8/1996 | Klodt et al. | 206/509 |
| 6,321,925 | B1 * | 11/2001 | Crouse et al. | 220/4.27 |
| 7,219,969 | B2 * | 5/2007 | Bezzubov | 312/107 |
| 7,320,405 | B2 * | 1/2008 | Stahl | 206/509 |
| 8,322,354 | B2 * | 12/2012 | Parker | 132/287 |
| 8,505,729 | B2 * | 8/2013 | Sosnovsky et al. | 206/508 |
| 8,720,687 | B2 * | 5/2014 | Hassell | 206/507 |
| 2002/0053529 | A1 | 5/2002 | White | |

(Continued)

FOREIGN PATENT DOCUMENTS

| | | |
|---|---|---|
| DE | 2154928 A1 | 5/1972 |
| DE | 7244356 U | 5/1974 |

(Continued)

OTHER PUBLICATIONS

European Search Report for EP 13 17 7723 dated Dec. 6, 2013 (corresponding European patent application).

*Primary Examiner* — Daniel Rohrhoff
(74) *Attorney, Agent, or Firm* — Fleit Gibbons Gutman Bongini & Bianco PL; Martin Fleit; Paul D. Bianco

(57) ABSTRACT

Container with a bottom wall, two side walls, and a back wall connecting them, and at least one drawer which can be pulled from the opening of the container, opposite this back wall, wherein on the upper edges of the two side walls, at least one locking device is provided. Such known containers are not flexible enough for practical use. The goal of refining a generic container in such a way that there are more combination possibilities in handling is attained in that the upper side of the container, opposite the bottom wall, is open and another container or a lid, covering the open upper side, can be optionally locked in via the locking device.

4 Claims, 4 Drawing Sheets

(56) References Cited

U.S. PATENT DOCUMENTS

| | | | | |
|---|---|---|---|---|
| 2004/0164653 | A1 | 8/2004 | Winkless | |
| 2006/0035125 | A1* | 2/2006 | Fujita et al. | 429/26 |
| 2007/0235963 | A1 | 10/2007 | Killinger et al. | |
| 2008/0121547 | A1* | 5/2008 | Dur et al. | 206/511 |
| 2009/0178989 | A1* | 7/2009 | Accuardi | 211/126.7 |
| 2010/0224528 | A1 | 9/2010 | Madsen | |
| 2011/0139666 | A1* | 6/2011 | Sosnovsky et al. | 206/508 |
| 2012/0241350 | A1* | 9/2012 | Stahl | 206/509 |
| 2013/0026057 | A1* | 1/2013 | Shapiro | 206/459.5 |

FOREIGN PATENT DOCUMENTS

| | | | |
|---|---|---|---|
| DE | 8605794 | U1 | 5/1986 |
| DE | 20104892 | | 10/2001 |
| DE | 102008058007 | B3 | 4/2010 |
| DE | 102011082155 | A1 | 11/2012 |
| EP | 0348789 | A2 | 1/1990 |
| EP | 1690796 | | 8/2006 |
| EP | 1851124 | | 11/2007 |
| WO | 2006/086900 | | 1/2006 |
| WO | 2006086900 | A1 | 8/2006 |
| WO | 2007121745 | A1 | 11/2007 |

* cited by examiner

CONTAINERS

CROSS REFERENCE TO RELATED APPLICATIONS

This application claims priority under 35 U.S.C. §119 to German Patent Application No. 10 2012 107 955.2 filed 29 Aug. 2012, the entire contents of which are incorporated herein by reference.

FIELD OF THE INVENTION

The invention concerns a container with a bottom wall, two side walls, and a back wall connecting them.

BACKGROUND OF THE INVENTION

DE 10 2008 058 007 B3 shows a stackable transport or storage container with a bottom and a container cover and four surrounding side walls, of which two opposite side walls have complementary locking elements on an upper and lower side, so that the container can be stacked, in an undisplaceable manner, via its base surface with models which are structurally identical with respect to the locking elements, wherein on the side walls with locking elements, furthermore, a spring-pretensioned locking catch is provided on both sides of the locking element and a complementary trap on the other complementary locking element, wherein when stacking, the locking catch of the one model interacts with the trap of the other model in a snap-closing manner and the models are automatically locked with one another.

From EP 0 348 789 A2, a forms storage compartment is known, which consists of containers that can be stacked and locked above one another. The containers have a bottom wall, two side walls, and a back wall connecting them. The upper side of the container, opposite the bottom wall, is open. The locking of two such containers, with one another, takes place via locking elements, which are located in the bottom wall of the upper container and mesh into corresponding locking recesses on the underside of a track of the lower container, located in the upper part of the side walls. To connect the two containers, they are first pushed laterally into one another, so that the upper container reaches under the track of the lower container, and then locks it by means of the locking elements. The locking elements are actuated by a slider located in the bottom wall of the container, which can be operated from the upper side of the bottom wall. The connecting of the containers takes place when they are not full, in which the slider is accessible and the lateral insertion is not additionally complicated by the increased weight of the containers.

In actual practice, it has become evident that, in addition to the containers to be stacked on one another, there is the need for drawers to be pulled out, in the same arrangement. In particular, craftsmen request combined solutions in which a stack or "rack," has not only containers, but also drawer elements. Proceeding from the initially mentioned publication, the applicant as subsequently developed the device offered on the market under the name LS-BOXX. This is a combination of a generic container that can be carried, with a fold-up lid and a drawer arrangement of a shape so that the side walls of the container are elongated downwards and form a holding space for one or more drawers, arranged above one another. In this solution, however, it is not possible to transport the drawer component by itself, because it is firmly connected with the container. The craftsman, therefore, must take along the whole container to the workplace, even if he needs only the drawer part.

SUMMARY OF THE INVENTION

Therefore, there is the problem of refining a generic container so that more combination possibilities in handling exist.

This problem is addressed with one aspect of the invention.

BRIEF DESCRIPTION OF THE DRAWINGS

An embodiment example of the invention, together with a variant, will be explained in more detail below, with reference to the accompanying drawings. The figures show the following.

DETAILED DESCRIPTION OF THE INVENTION

Figure 1:
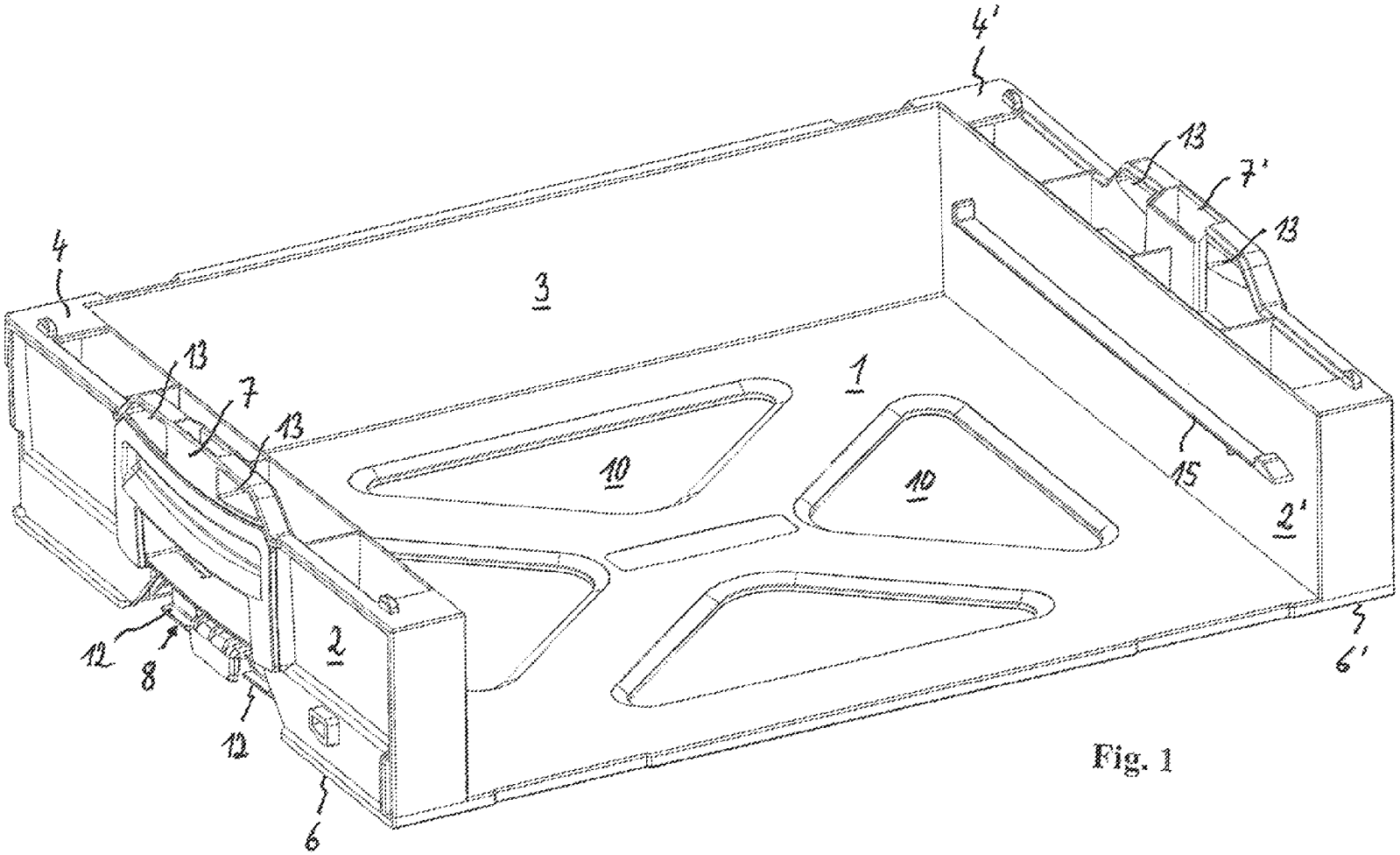
FIG. 1: a perspective view of a container in accordance with the invention.
Figure 2:
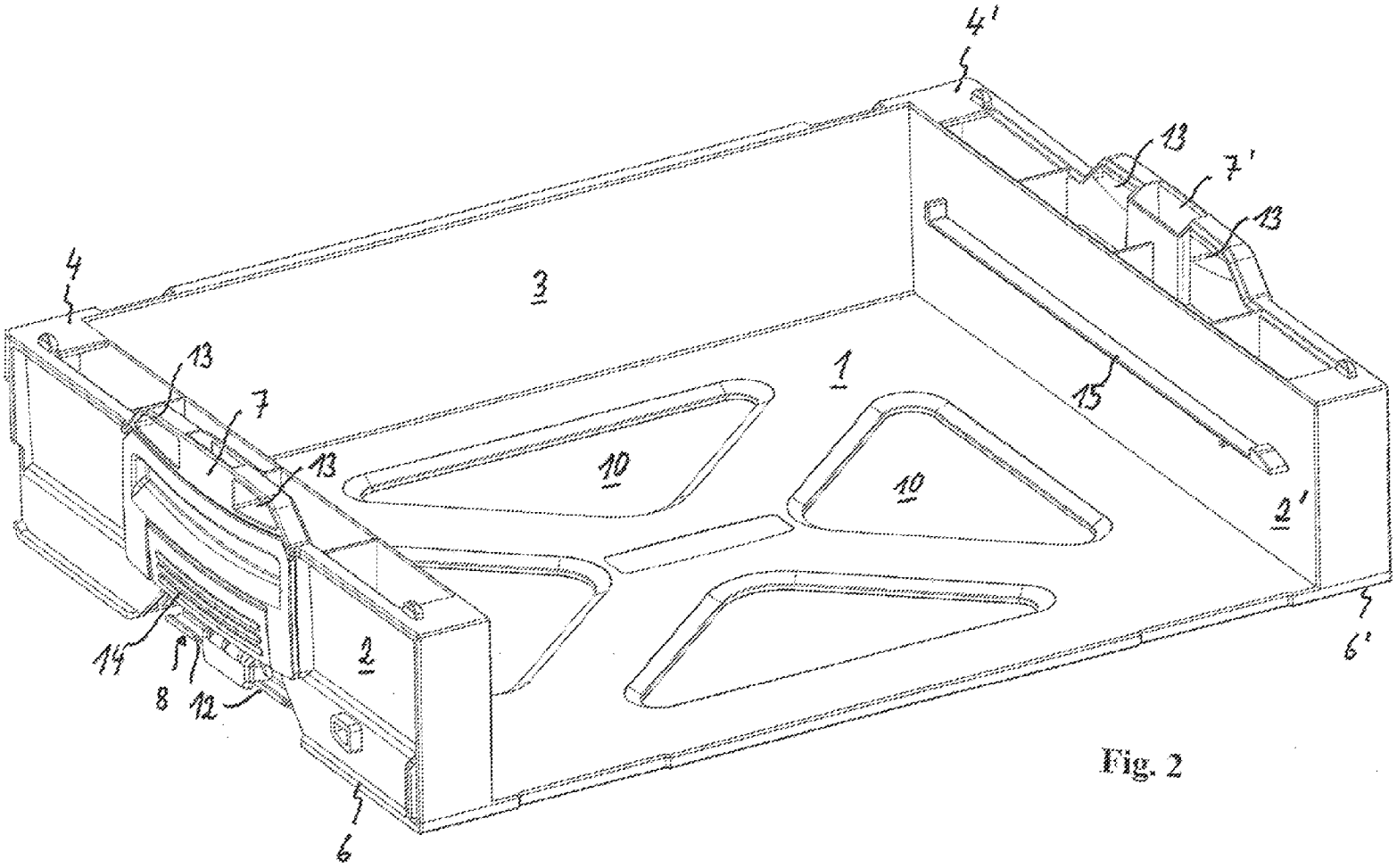
FIG. 2: a perspective representation of a variant of the container shown in FIG. 1.

FIGS. 1 and 2 show two embodiment variants of a container in accordance with the invention.

Figure 4:
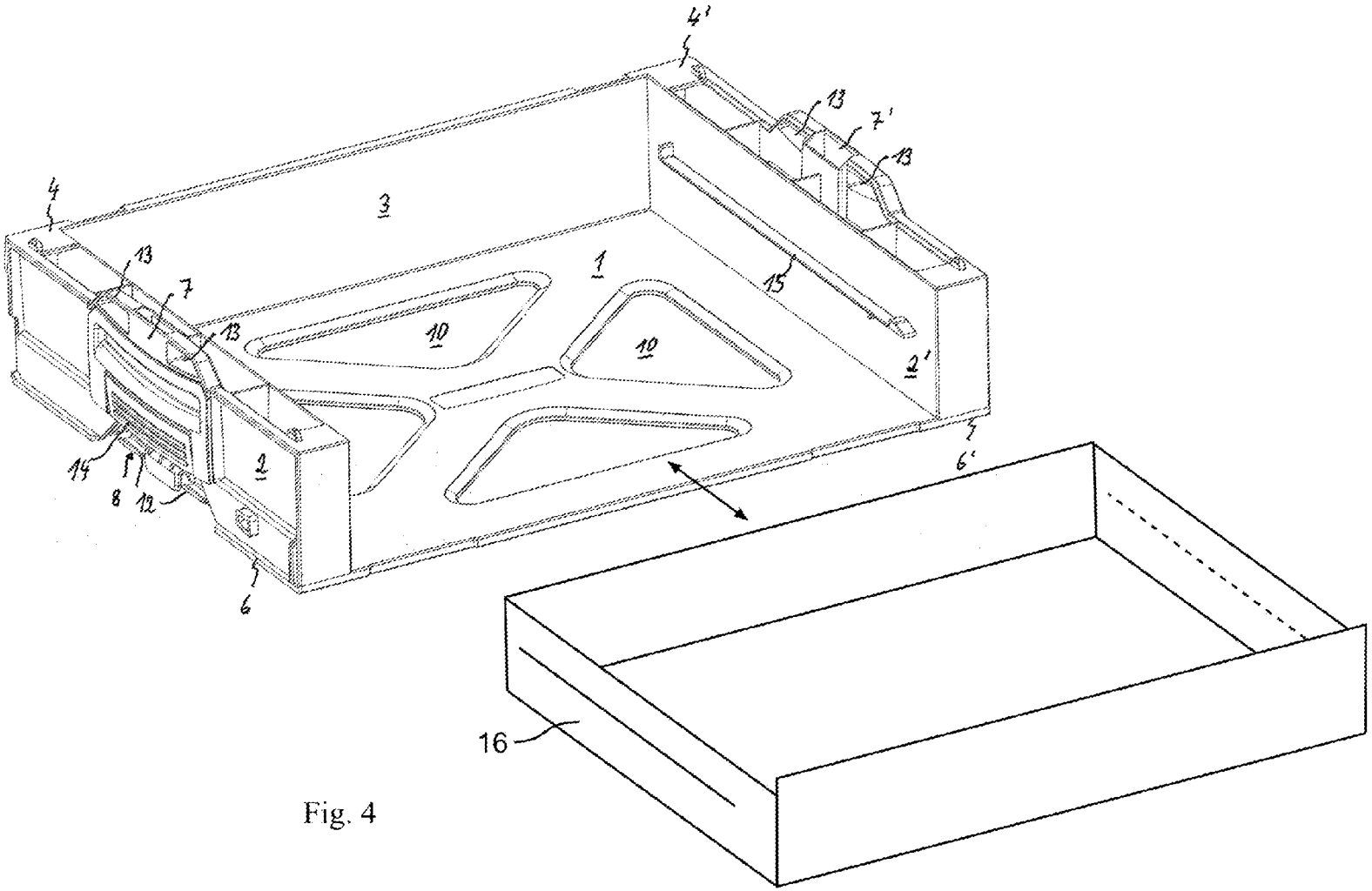
FIG. 4: a perspective view of a drawer and container in accordance with the invention.

In both cases, it has a bottom wall 1, two following, opposite side walls 2 and 2', and a back wall 3, connecting these two side walls 2, 2'. On the inside of the two side walls 2 and 2', there are guide tracks 15 for a drawer 16 (FIG. 4) to engage with recesses in the side walls, so that this drawer can be pulled out of and again pushed into the container via the guide tracks 15 and the front opening. In the depicted variants, the guide tracks 15 have front and back stops, so that the drawer cannot accidentally be pulled out completely, but rather the front stop must first be overcome—for example, by lifting the drawer.

For the purpose of producing a savings in the material used, the bottom walls 1 are provided with recesses 10 in both variants. The container is preferably made of plastic, for example, an ABS plastic, and is produced in an injection molding process. The same is true for the drawer 16 to be used and the lid 5, which will be discussed individually, further below.

Locking devices 7 and 7' can be found on the upper edges 4 and 4' of the two side walls 2 and 2'. The embodiment examples shown are hereby the wall parts, protruding from the middle area of the upper edges 4 and 4', with two openings 13, designated as traps, in the following.

On the lower edges 6 and 6' of the side walls 2 and 2' of the container, there are corresponding complementary locking devices 8 in its middle area. The two variants in accordance with FIGS. 1 and 2 differ in the development of these complementary locking devices 8, wherein in both cases, hooking lugs 12 are provided for engagement in the traps 13 of an essentially structurally identical container, located underneath.

In the variant according to FIG. 1, these hooking lugs 12 are arranged so flexibly elastic on the container and so firmly connected with it that upon placing the container on an identical container, located underneath, into the corresponding traps 13 of the locking device 7 and 7' on the upper edges 4 and 4', they are snapped in by their side walls 2 and 2'. In this case, a solution of two containers stacked above one another and locked with one another is not possible or is possible only if a tool is used, whereas, then, the hooking lugs 12 locked into the traps 13, with the use of a tool, have to be pressed again out of these traps 13. Therefore, this variant is suitable for cases in which a permanent connection of containers stacked above one another is desired.

In the variant shown in FIG. 2, the hooking lugs 12 are not firmly placed on the container, but rather are connected with it in an articulated manner, wherein the movement of the locking lugs 12 takes place around an articulation axis, running parallel to the side wall 2 and 2', via an actuation handle 14. If one presses the actuation handle 14 inwards, the locking lugs 12 swivel inwards and the container can be placed on an identical container. Subsequently, the actuation handle 14 is released and the locking lugs 12 engage in the traps 13 of the container located underneath. To release the containers, the actuation handle 14 is simply pressed once more and the container can be removed from the container lying underneath.

Figure 3:
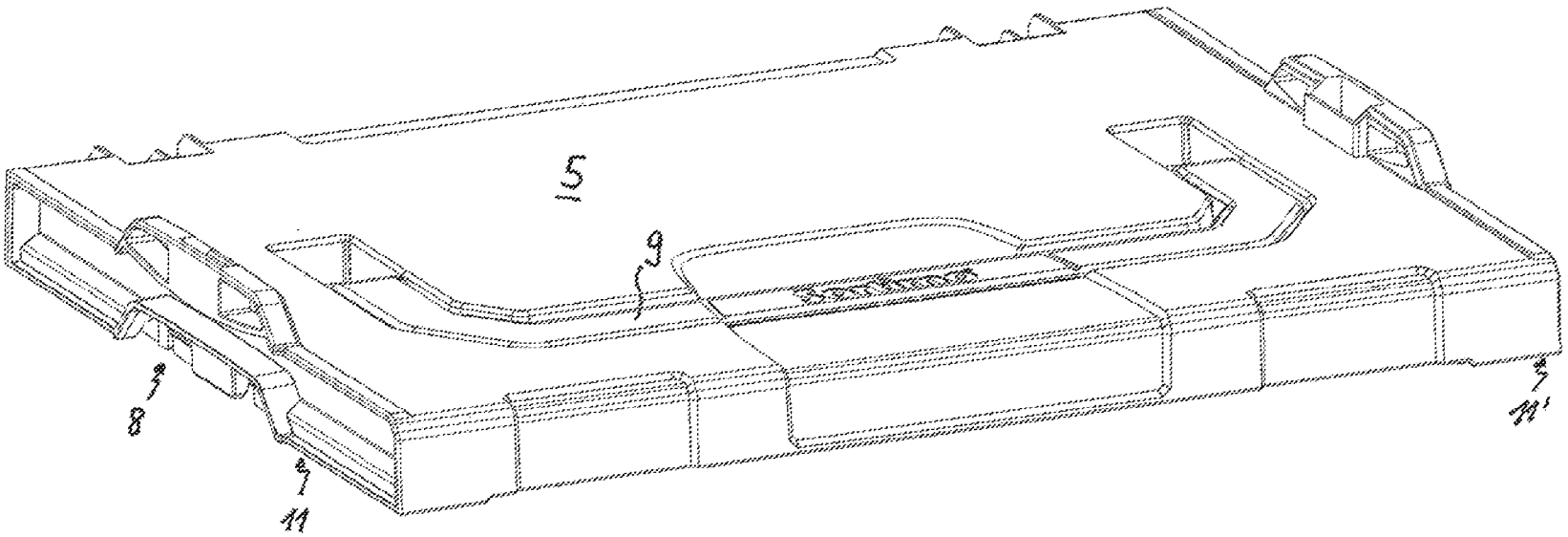
FIG. 3: a perspective representation of the lid for the containers shown in FIGS. 1 and 2.

In the two embodiment variants, in accordance with the invention, the upper side of the container is designed open—that is, neither directly covered nor closed with a container, lying above, with a fold-up lid. In this way, it is possible, in accordance with the invention, to lock either an identical or similar container on the above open container or to provide the upper opening with a lid 5, as it is shown in FIG. 3. Also the lid 5 has complementary locking devices 8 on its lateral lower edges 11 and 11' to engage the locking devices 7 of the upper side of a container 5 located underneath, so that it can be placed on the container either permanently or firmly or so it can be removed.

Preferably, the lid 5 has a retractable handle 9 on its upper side, which when folded, almost completely disappears in the surface of the lid 5 and when folded out, makes possible the carrying of the lid and the container locked underneath or several containers locked underneath.

In a nondepicted variant of the container in accordance with the invention, it is possible for it to be designed higher and to have more guide tracks 15 for drawers lying above one another. Thus, a single container can have two, three, four, or more drawers located above one another.

With the container in accordance with the invention, a high variability of use is possible, since the craftsman can combine both classic boxes and also only the drawer parts with one another and can transport them, together or separately from one another, to the place of use.

All references cited herein are expressly incorporated by reference in their entirety. In addition, unless mention was made above to the contrary, it should be noted that all of the accompanying drawings are not to scale. There are many different features to the present invention and it is contemplated that these features may be used together or separately. Thus, the invention should not be limited to any particular combination of features or to a particular application of the invention. Further, it should be understood that variations and modifications within the spirit and scope of the invention might occur to those skilled in the art to which the invention pertains. Accordingly, all expedient modifications readily attainable by one versed in the art from the disclosure set forth herein that are within the scope and spirit of the present invention are to be included as further embodiments of the present invention.

What is claimed is:

1. A container comprising:

a bottom wall, two side walls, and a back wall connecting the bottom wall with the two side walls;

a guide track system having at least one guide track disposed on an inner surface of each of the two side walls, the at least one guide track having a ramped guide face disposed on a first end of the guide track and a stop disposed on a second end of the guide track;

at least one drawer configured to engage with the guide track system allowing the at least one drawer to be pulled out of an opening of the container, opposite the back wall;

at least one locking device disposed on the outer surface and upper edges of the two side walls;

wherein an upper side of the container, opposite the bottom wall, is open and at least one of another container and a lid, covering the open upper side, can be optionally locked, via the locking device;

wherein the outer surface of the side walls of the container and the at least one of another container and a lid, on lower edges, have a complementary locking device for locking a container located underneath, the complementary locking device having an at least one locking lug and an at least one actuation handle, the at least one locking lug configured to engage in a corresponding trap on the at least one locking device; and the at least one locking lug arranged on the container in an articulated manner and configured to be swiveled via the at least one actuation handle, wherein the locking lug can be moved by actuating the actuation handle to release containers stacked on one another from the trap.

2. The container according to claim 1, wherein the lid has an unfolded position and in the folded position in the surface of the lid, at least a partially vanishing handle.

3. The container according to claim 1, wherein the bottom wall is provided with recesses.

4. The container according to claim 1, wherein the container and the lid are produced from ABS plastic in an injection molding process.

* * * * *